United States Patent [19]

Ikeda

[11] 4,044,541

[45] Aug. 30, 1977

[54] PROCESS FOR PRODUCING TEXTURED POLYESTER MULTIFILAMENT YARN

[75] Inventor: Morio Ikeda, Matsuyama, Japan

[73] Assignee: Teijin Limited, Osaka, Japan

[21] Appl. No.: 566,758

[22] Filed: Apr. 10, 1975

[30] Foreign Application Priority Data

Apr. 15, 1974 Japan ..... 49-40897

[51] Int. Cl.[2] ..... D02G 1/02

[52] U.S. Cl. ..... 57/157 TS; 57/140 R; 57/164

[58] Field of Search ..... 57/34 HS, 157 TS, 157 S, 57/164, 140 R

[56] References Cited

U.S. PATENT DOCUMENTS

| | | | |
|---|---|---|---|
| 3,747,318 | 7/1973 | Cochran | 57/157 TS |
| 3,771,307 | 11/1973 | Petrille | 57/157 TS |
| 3,772,872 | 11/1973 | Piazza et al. | 57/140 R |
| 3,837,156 | 9/1974 | Langanke et al. | 57/157 TS |

*Primary Examiner*—John Petrakes

*Attorney, Agent, or Firm*—Burgess, Ryan and Wayne

[57] ABSTRACT

Textured polyester multifilament yarn having uniform quality in dye-absorbing properties and crimp properties is produced by a combined draw-texturing method wherein a feed yarn composed of a plurality of polyester filaments having a birefringence of at most 0.04 is drawn and simultaneously or sequentially textured, said feed yarn being produced by meltspinning a synthetic linear ethylene terephthalate polymer to form an undrawn multi-filament yarn, winding up the undrawn yarn and, before and/or after the winding operation, applying to the undrawn yarn a finishing agent which is not capable of diffusing into the inside of the filaments but is capable of preventing protuberance formation at a surface protuberance number larger than 5 on the surface of the filaments when the feed yarn is aged at a temperature of 40° C at a relative humidity of 70% for 21 days and, then, twisted at a twist number of $32500/\sqrt{D}$ turns/m, wherein D represents a denier of the feed yarn, without drawing.

8 Claims, 5 Drawing Figures

PROCESS FOR PRODUCING TEXTURED POLYESTER MULTIFILAMENT YARN

The present invention relates to a process for producing textured polyester multifilament yarn, and more particularly, relates to a process for producing textured yarn with a uniform quality from synthetic linear ethylene terephthalate polymer multifilament feed yarn having an excellent stability in processing properties.

A new process for producing textured polyester yarn, which is being further developed while being used, is a combined draw-false twisting process wherein the false-twisting operation for the undrawn polyester multifilament feed yarn is carried out either simultaneously with or subsequent to the drawing operation. The new process is advantageous in that it results in a large reduction in the production cost of the textured yarn, because the drawing operation and the false-twisting operation are effected in a simple process. However, the process has the disadvantages that the undrawn feed yarn has a tendency to change its processing properties with the lapse of time, and that the quality of the resultant textured yarn varies, especially, with regard to dye-absorbing property. That is, if the combined draw-false twisting process is carried out using a plurality of packages of undrawn feed yarns having different processing properties from each other, the resultant textured yarn is not uniform in its dye-absorbing properties. Accordingly, when the textured yarn is dyed, the color depth of the resultant dyed yarn is uneven. Usually, the textured yarn obtained from a feed yarn changed in quality tends to be dyed a deeper color than that from a feed yarn not changed in quality.

Recently, attempts have been made to produce an undrawn polyester multifilament feed yarn resistant to change in quality with the lapse of time by carrying out the melt-spinning operation for the polyester at a high windup speed of 3000 to 4000 yard/minute. However, the high speed meltspinning method requires a highly skilled operator and a special apparatus for carrying out the method. Further, the resultant undrawn feed yarn is not always satisfactory in its resistance to change in quality with the lapse of time.

The inventor has conducted a systematic study concerning unevenness in quality, especially, the dye-absorbing properties, of textured polyester yarn with the lapse of time due to changes in quality of the undrawn polyester feed yarn. As a result of these studies it has been discovered that, the heretofore widely accepted idea that the change in quality of an undrawn polyester feed yarn with the lapse of time is the result of natural changes in the microstructue of the filaments is incorrect. Further, it has been discovered that the change in quality with the lapse of time of the undrawn polyester feed yarn is principally the result of the undesirable diffusion into the inside of the filament of a finishing agent applied to the feed yarn surface, and that the diffused finishing agent causes formation of many protuberances on the feed yarn surface when the feed yarn is twisted in the false-twisting operation. The present invention has been completed based on the above discoveries.

The object of the present invention is to provide a process for producing textured polyester multifilament yarn having a uniform quality, especially, an even dye-absorbing property.

The above object can be accomplished by the process of the present invention which comprises the steps of:

providing a feed yarn consisting of a plurality of synthetic linear ethylene terephthalate polymer filaments having a birefringence value of at most 0.04, by melt-spinning said linear polyester to form an undrawn multifilament yarn, winding up said undrawn multifilament yarn and, before and/or after said winding operation, applying to said undrawn multifilament yarn, a finishing agent not capable of diffusing into the inside of said filaments but capable of preventing formation of protuberances at a surface protuberance number larger than 5, which will be defined hereinafter, on the surface of said filaments when said feed yarn is twisted at a twist number of $32500/\sqrt{D}$ turns/m, wherein D represents a denier of said feed yarn, without drawing the yarn after aging said feed yarn at a temperature of 40° C at a relative humidity of 70% for 21 days, and;

subjecting said feed yarn to a simultaneous or sequential draw-texturing operation.

The features of the process of the present invention will be more fully explained in the following description with reference to the accompanying drawings, in which.

Figure 1:
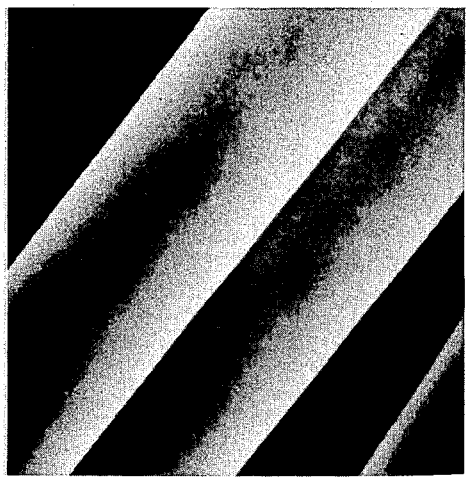
FIG. 1 is a scattering electron microscopic photograph showing a surface view of spun, undrawn polyester filaments just after the melt-spinning operation.

The linear ethylene terephthalate polymer usable for the present invention may be either polyethylene terephthalate or a copolymer consisting of at least 80% by mole of copolymerized ethylene terephthalate and at most 20% by mole of the other copolymerized components. The other component may contain one or more dibasic acid components for example, phthalic acid, suberic acid, gluraric acid, pimelic acid, fumaric acid or succinoic acid, and; one or more dihydric alcohol components, for example, polymethylene glycols having 2 to 10 carbon atoms (for example, trimethylene glycol and butylene glycol) and cyclohexane dimethanol.

The linear ethylene terephthalate polymer may contain a minor amount of a modifier component, for example, 5-oxydimethyl isophthalate, 5-oxydimethyl hexahydroisophthalate, benzene-1,3,5-tricarboxylic acid, p-carbomethoxyhenyl diethyl phosphonate, 3,5-dicarboxy phenyl diethyl phosphate, pentaerythritol, glycol, phosphoric acid, triphenyl phosphate, tri-1-carbomethoxyphenyl phosphate, triphenyl arsenite, tricapryl borin acid, sorbitan; trimesic acid or diethylene glycol. Furthermore, the linear ethylene terephthalate polymer may contain a small amount of another polymer such as a polyamide, polycarbonate or polyolefin.

The linear ethylene terephthalate polymer preferably has an intrinsic viscosity of 0.3 to 1.2 which is determined using a solution of the polymer in O-chlorophenol at a temperature of 35° C.

The type of the linear polyester as mentioned above is subjected to the melt-spinning process with or without additive, for example, delustering agent such as titanium oxide, coloring material such as pigments, fire-resistant agent and antistatic agent. The melt spinning operation may be carried out in accordance with the conventional method. That is, the linear polyester is melted in an extruder, the melt is extruded through a spinneret, the extruded melt in the form of filaments are solidified by cooling. The filaments thus formed are bundled and wound up. The windup speed is 2750 m/min or lower. In order to increase production efficiency of the multifilament yarn, a relatively high windup speed between 1500 and 2500 m/min is preferable, and a windup speed of 1750 to 2000 m/min is even more preferable.

In the process of the present invention, the most desirable undrawn polyester yarn is composed of a plurality of polyester filaments having a birefringence of at most 0.04, preferably, 0.01 to 0.03. The undrawn polyester yarn may not only have a circular cross-sectional profile, but also a non-circular cross-sectional profile, for example, triangle, quadangle, pentagonal, hexagonal, flat, cruciform, multi lobal (with 3 to 10 lobes) and hollow (doughnut and non-circular) cross-sectional profiles. The undrawn polyester yarn preferably has a denier of 30 to 700, more preferably, 50 to 500.

In the conventional process for producing polyester multifilament yarn, a finishing agent is applied to the spun, undrawn filaments during or after the melt-spinning operation period in order to improve the bundling property, lubricity and antistatic property of the undrawn filaments. However, the inventor has discovered that if a conventional finishing agent, which is capable of diffusing into the inside of the undrawn filaments, is applied to the spun, undrawn multi-filament yarn to prepare the feed yarn, the resultant feed yarn has a tendency to form numerous protuberances on the surface of the filaments when the feed yarn is aged over a long period of time and, thereafter, twisted at a relatively high twist number. The protuberances thus formed on the filament surface cause undesirable change in the dye-absorbing property of the textured polyester multifilament yarn.

In the Inventor's study, an undrawn polyethylene terephthalate multifilament yarn of 360 deniers/30 filaments was produced by a melt-spinning method in which a finishing agent of the Composition B indicated in Example 1, which could diffuse into the inside of the filaments, was applied to the spun filaments, and; thereafter, the multi-filament yarn was wound up at a windup speed of 1,800 m/min. The undrawn multifilament yarn thus wound up had a surface view of filaments as shown in FIG. 1, which is a scattering electron microscopic photograph at a magnification of 1,000. Referring to FIG. 1, it is obvious that the filament surfaces are smooth with no protuberances.

Figure 2:
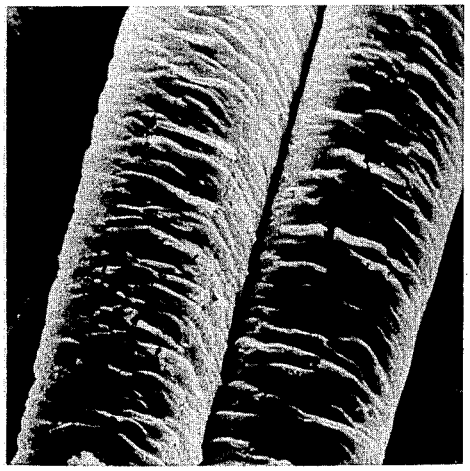
FIG. 2 is a scattering electron microscopic photograph showing a surface view of spun, undrawn polyester filaments not usable as a feed yarn for the present invention, which have been finished with a conventional finishing agent capable of diffusing into the inside of the filaments, aged at a temperature of 40° C at a relative humidity of 70% for 21 days and, thereafter, twisted and untwisted.

When the same undrawn, finished multifilament yarn as in FIG. 1 was aged at a temperature of 40° C at a relative humidity of 70% for 21 days and, thereafter, twisted at a twist number of 1710 turns/m at a temperature of 20° C and untwisted, it was observed by way of scattering electron microscopic photography that numerous protuberances were formed on the filament surfaces. Referring to FIG. 2 which is a scattering electron microscopic photograph at a magnification of 1,000, the filament surfaces have numerous protuberances and concave portions formed between the protuberances.

Figure 5:
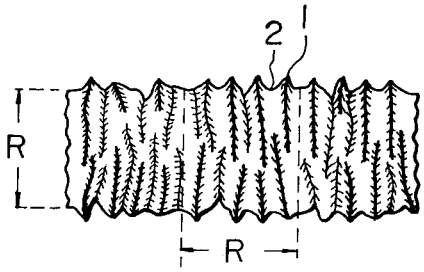
FIG. 5 shows a model surface view of a spun, undrawn polyester filament not usable as a feed yarn for the present invention which filament has been aged, twisted and untwisted in the same manner as those in FIG. 2.

A model view of the filament surface in FIG. 2 is shown in FIG. 2 is shown in FIG. 5. Referring to FIG. 5, numerous protuberances 1 are formed on the filament surface and numerous concave portions 2 are formed between the protuberances.

Figure 3:
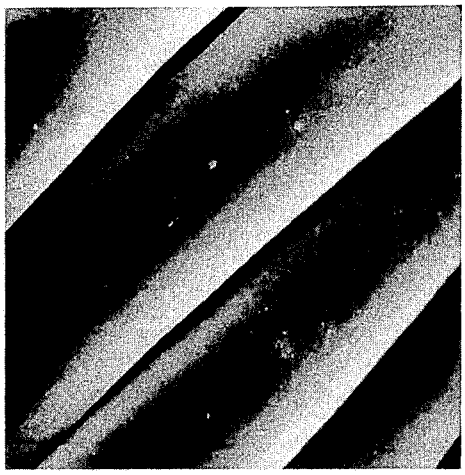
FIG. 3 is a scattering electron microscopic photograph showing a surface view of spun, undrawn polyester filaments usable as a feed yarn for the present invention, which filaments have been finished with a finishing agent not capable of diffusing into the inside of the filaments and aged, twisted and untwisted in the same manner as those of FIG. 2.

The same procedures as those applied to the multifilament yarn of FIG. 2 were repeated using a finishing agent of the Composition A indicated in Example 1, which is not capable of diffusing into the inside of the filaments, instead of the conventional finishing agent. Referring to FIG. 3, which is a scattering electron microscopic photograph in a magnification of 1,000 of the resultant untwisted filaments mentioned above, substantially no, or very few, protuberances are observed on the surfaces of the filaments.

Figure 4:
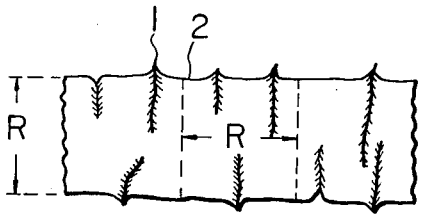
FIG. 4 shows a model surface view of a spun, undrawn polyester filament usable as a feed yarn for the present invention which filament has been aged, twisted and untwisted in the same manner as those in FIG. 2.

A model view of the filament surfaces in FIG. 3 is shown in FIG. 4. Referring to FIG. 4, a few protuberances 1 and concave portions 2 are formed on the filament surface.

The undrawn, finished polyester multifilament yarn of FIG. 1 could be successfully textured, just after the winding up operation, by way of draw-false twisting without difficulty, for example, yarn breakage or filament breakage, which causes formation of fluffs on the yarn surface, and partial non-untwisting of the yarn. However, when the same undrawn, finished polyester multifilament yarn as used in FIG. 2 was textured, after the same aging operation as applied to the yarn in FIG. 2, by way of draw-false twisting, frequent yarn breakages, filament breakages and partial non-untwistings were observed. Further, it was found that the resultant textured yarn was uneven in quality, for example, dye-absorbing property, crimp, tenacity and break elongation.

Compared with the above, the same undrawn, finished polyester multifilament yarn as used in FIG. 3 could be successfully textured by way of the draw-false twisting without difficulty, even if the texturing operation was effected after the same aging operation as used for the yarn in FIG. 3 was completed. That is, during the texturing operation period, substantially no yarn breakage or filament breakage, which causes formation of fluffs on the yarn surface, or partial non-untwisting was observed. Also, it was observed that the resultant textured yarn was uniform in quality, for example, dye-absorbing property, crimp, tenacity and breaking elongation.

From the above observations, it is concluded that the change in quality of the undrawn polyester multifilament yarn with the lapse of time is the result of the diffusion of the finishing agent into the skin portions of the filaments. That is, after aging for a long period, a finishing agent diffuses into a skin portion of the filament so as to modify the physical properties of the skin portion. When a large number of twists are applied to the undrawn, finished polyester feed yarn, the skin portion of the filament into which the finishing agent is diffused has numerous protuberances and concave portions. These protuberances and concave portions principally cause the unevenness in dye-absorbing property of the textured polyester yarn. The larger the number of the protuberances and concave portions the higher the dye-absorbing property of the textured polyester yarn.

Broadly speaking, it was generally believed heretofore that the unevenness in dye-absorbing property of textured polyester yarn was derived from the natural change in the microstructure of the feed yarn with the lapse of time. However, the inventor has discovered that this is incorrect and that the uneveness in quality of the textured polyester yarn is principally the result of the diffusion of the finishing agent into the inside of the filaments. This discovery changes the entire concept upon which the prior arts have been based.

Based on the above mentioned discovery, a textured polyester yarn having a uniform quality can be produced from an undrawn feed yarn consisting of a plurality of synthetic linear ethylene terephthalate polymer filaments, said filaments having a birefringence of at most 0.04, preferably, at most 0.03, and being highly resistant to protuberance formation when twisted after a long period of aging.

The above-type of undrawn feed yarn is produced by melt-spinning the linear ethylene terephthalate polymer to form a multifilament yarn and, during or after the melt-spinning operation, applying a finishing agent not capable of diffusing into the inside of the filaments but capable of preventing formation of protuberances at a surface protuberance number larger than 5 on the surface of the filaments when the feed yarn is twisted in the manner as mentioned hereinbefore.

The above-mentioned surface protuberance number was determined by the following method.

An undrawn, finished polyester feed yarn in the form of a package is aged, at a temperature of 40° C at a relative humidity of 70% for 21 days. The aged feed yarn is twisted at a twist number of $32500/\sqrt{D}$ turns/m, wherein D represents denier of the undrawn feed yarn at an ambient temperature, for example, between 10° to 40° C. The twisting operation may be carried out by any type of conventional twisting apparatus. The twisting apparatus may also be any type of twist counter. The initial tension on the feed yarn in the twisting operation is determined in response to denier of the yarn and denier of the filaments to such an extent that under the tension the feed yarn is not substantially drawn, for example, 0.04 g/denier of the feed yarn. The twisting speed is also determined in response to the denier of the feed yarn and the filaments, for example, between 5 to 100 turns/sec.

The twisted feed yarn is released from the twist so as to allow the feed yarn to be completely untwisted. The surfaces of the untwisted feed yarn filaments are observed by a scattering electron microscope and the number of protuberances formed on the filament surfaces is measured by the following method.

Referring to FIGS. 4 and 5, the average diameter R of a portion of the filament is determined. The number of protuberances observed at a portion having a length the same as the diameter R, of the filament is counted. The counting of the number of the protuberances is repeated 10 times at different portions of the filament. An average value of the number of protuberances is referred to as the surface protuberance number of the feed yarn filaments.

In the process of the present invention, it is required that the finishing agent be not capable of diffusing into the inside of the filament, but be capable of preventing protuberance formation at a surface protuberance number larger than 5. The finishing agent which can fill the above requirement may consist essentially of an ester oil lubricant, mineral oil lubricant, silicon oil lubricant, polyether lubricant consisting of copolymers of propylene oxide and ethylene oxide having a molecular weight of at least 2000, non-ionic surface active compounds with branch groups having 0 to 50 carbon atoms, or a mixture of two or more of the abovementioned substances. The finishing agent may preferably contain therein an anti-static agent in an amount of 10% by weight or less, preferably 5% by weight or less. The ester oil lubricant may be selected from the group consisting of esters having a molecular weight of 400 or more of higher fatty alcohols having 10 carbon atoms or more and higher fatty acids having 10 carbon atoms or more, mono-, di- and tri-esters with a molecular weight of 400 or more of polyhydric alcohols and fatty acids and mixtures of two or more of the above mentioned esters. The mineral oil lubricant may be selected from the group consisting of non-volatile liquid paraffins, naphthenes and aromatic hydrocarbons and mixtures of two or more of the above-mentioned substances. The silicone oil lubricant may be selected from the group consisting of dialkylpolysiloxanes, for example, dimethyl-polysiloxane and modified polysiloxane compounds respectively having a molecular weight of 1000 or more. The polyether lubricant may be selected from the group consisting of polyethers having a molecular weight of 2000 or more, which are condensation products of alcohols having at least one hydroxyl radial with polymerized propylene oxide and/or ethylene oxide. Further, the non-ionic polymeric surface active compound may be selected from the group consisting of alkyl ethers, alkyl esters, sorbitol esters and condensation products of the above-mentioned compounds with polymerized ethylene oxide and/or propylene oxide, respectively having a molecular weight of 200, and mixtures of two or more of the above-mentioned compounds.

The finishing agent may be a mixture of two or more of the above-mentioned compounds. Particularly, the most preferable finishing agent is a mixture containing at least one member selected from the group consisting of said ester oil, mineral oil, silicone oil and polyether lubricants and at least one member selected from said non-ionic surface active compounds.

Conventional ionic materials, that is, anionic and cationic, surface active compounds are not desirable as the finishing agent usable for the process of the present invention, even if the compounds are of a relatively large molecular weight, because of a relatively large tendency thereof to diffuse into the inside of the polyester filaments. However, it is permissible that the finishihg agent include therein at most 10% by weight, preferably, at most 5% by weight, of an anti-static agent.

The finishing agent can be applied to the undrawn multifilament yarn by a conventional method, for instance, roller-finishing method or spray-finishing method. There is no limitation in the amount of the finishing agent to be applied to the undrawn multifilament yarn. However, it is preferable that the finishing agent be applied in an amount of 0.2 to 1.0% based on the weight of the undrawn multifilament yarn. The finishing agent is applied to the undrawn multifilament yarn in at least one stage before and/or after the winding operation. That is, the finishing agent may be applied before the winding operation and, thereafter, the finished yarn, that is, feed yarn may be wound up to form a package. Also, the finishing agent may be applied to the feed yarn withdrawn from the package just before the draw-texturing operation. Further, the finishing agent may be applied in an amount of 0.3% or less, based on the weight of the undrawn yarn, before the winding operation and, thereafter, the finishing agent may be applied in an amount of 0.7% or less, based on the weight of the undrawn yarn, so as to complete the process for providing the feed yarn. The type of finishing agent used before the winding operation may be the same as or different from that used after the winding operation. In any event, the sum of the weights of the finishing agents applied to the undrawn yarn before and after the winding operation is preferably in an amount between 0.2 to 1.0%, based on the weight of the undrawn yarn.

Before the winding operation, the undrawn multifilament yarn may be bundled by action of an air turbulent or eddy stream. Also, the feed yarn may be bundled by the action of an air turbulent or eddy stream just before the draw-texturing operation.

The polyester feed yarn prepared by the above-mentioned method in accordance with the present invention is extremely stable in aging and undergoes substantially no change in quality with the lapse of time. For example, the polyester feed yarn prepared in accordance with the process of the present invention in which the winding operation has a windup speed of 1800 m/min, undergoes no change in quality even after the complete aging of the feed yarn at a temperature of 35° C at a relative humidity of 70% for 60 days.

Since the polyester feed yarn has an excellent stability in aging for a long period, special consideration for the storage or shipping of the feed yarn is unnecessary. For example, even if the feed yarn is transported to a far away draw-texturing factory by ship, train or truck over a long period, substantially no, or only an extremely small, change results therefrom in its quality, especially, its processing property.

The feed yarn is subjected to a draw-texturing operation. The draw-texturing operation may be of an indraw type in which the false twisting operation is carried out simultaneously with the drawing operation, or of an outdraw type wherein the false twisting operation is effected subsequent to the drawing operation. There is no limitation as to the exact type of apparatus to be used for carrying out the draw-texturing operation in accordance with the process of the present invention. However, it is preferable that the draw-texturing operation be carried out at a mechanical draw ratio of 1.5X to 3.5X, more preferably, 1.6X to 3.0X, and at heat-setting temperature of 160° to 230° C. The draw-textured yarn preferably has a denier of 20 to 200, more preferably, 75 to 150.

The draw-texturing operation using the feed yarn in accordance with the present invention can be carried out smoothly with substantially no, or extremely little, difficulty. That is, the frequencies of yarn breakage, filament breakage which causes formation of fluffs on the yarn surface and partial non-untwisting of the textured yarn in the draw-texturing operation are greatly reduced. Further, it should be noted that the resultant textured yarn is uniform in quality, namely, number, durability and elasticity of crimps, mechanical properties and dye-absorbing property of the yarn.

The examples below are presented for the purpose of illustrating various processes of practicing the present invention. All quantities in part or percent in the examples are on a weight basis unless otherwise indicated.

In the examples, the measurement values were obtained by the following methods.

1. Surface Protuberance Number

This was determined by the method as mentioned hereinbefore.

2. Dye-Absorbing Property

The dye-absorbing property of the textured yarn was determined by the following method. A standard sample was prepared by draw-texturing the same feed yarn as that from which the textured yarn to be tested was prepared, within 8 hours after the completion of the winding operation. The standard sample and the testing sample were knitted side by side in one piece, and the knitted fabric thus prepared was dyed by immersing it in a boiling dye bath containing 2% of Eastman Polyester Blue GLF (C.I. Disperse Blue 27) for 90 minutes to allow the knitted fabric to exhaust the dye in the bath.

The difference in color depth between the testing sample and the standard sample was observed by the naked eye and evaluated on the scale indicated below. The above procedures were repeated 10 times. The dye-absorbing property of the testing textured yarn was represented by the following average values of the differences in color depth between the testing sample and the standard sample for ten pieces of the knitted fabric.

0: Not distinguishable from the standard sample
0.5: Slight difference from the standard sample
1.0: Difference easily seen from the standard sample
1.5: When a yarn having a difference of 1.0 from the standard sample is made the standard sample, there is a slight difference from this standard sample
2.0: Using a yarn having a difference of 1.5 from the original standard sample as the standard sample, there is a slight difference from this standard sample Differences larger than 2.0 were given an average value using a standard sample determined by the same method as used for the values of 1.5 and 2.0.

The plus symbol means that the testing sample had more color depth than that of the standard sample, and the minus symbol means that the testing sample had less color depth than that of the standard sample.

3. Degree of Total Crimp (TC)

A light load of 2 mg/denier and a heavy load of 0.2 g/denier were exerted at the same time on a textured yarn of a predetermined length to tighten up the textured yarn. One minute after the tightening, the length of the textured yarn was measured and designated $l_0$. Thereafter, only the heavy was removed. The textured yarn was immersed in boiling water for 20 minutes under the light load and, then, naturally dried in the atmosphere for 24 hours under no tension. Next, both the light load and the heavy load were simultaneously exerted on the dried textured yarn to tighten the yarn again. One minute after the tightening, the length of the textured yarn was measured and represented by $l_1$. The textured yarn was released from just the heavy load and maintained for 1 minute under the light load. Thereafter, the length of the textured yarn was measured and designed $l_2$. The degree of total crimp (TC) of the textured yarn was calculated in accordance with the following equation.

$$TC = \frac{l_1 - l_2}{l_0} \times 100\ (\%)$$

EXAMPLE 1 AND COMPARATIVE EXAMPLE 1

In Example 1, a polyethylene terephthalate feed yarn of 360 deniers/30 filaments was produced by the following procedures. Polyethylene terephthalate pellets having a limiting viscosity of 1.65 was melted at a temperature of 285° C in an extruder and the melt was extruded through a spinneret and wound up at a windup speed of 1800 m/min. A roller for applying a finishing agent was located between the spinneret and the winding device. The finishing agent of the composition A indicated hereinafter was emulsified in water. The emulsion was applied to the yarn in such a manner that the finishing agent in the emulsion was applied in an amount of 0.5% based on the weight of the yarn. The filaments in the resulting feed yarn had a birefringence of 0.0160.

| Composition A | |
|---|---|
| Component | part |
| Benzylphenylphenol ether of polyethylene glycol having a degree of polymerization of 6 | 18 |
| Caster oil ether of polyethylene glycol having a degree of polymerization of 30 | 8 |
| Copolymer of propylene oxide and ethylene oxide having a molecular weight of 4000 | 10 |
| Dioctyl sebacate | 20 |
| Trimethylpropane tridecanoate | 35 |
| Nonylphenol ether of polyethylene glycol having a degree of polymerization of 5 | 9 |

The feed yarn was divided into three package and each package of the feed yarn was subjected to aging at a temperature of 40° C at a relative humidity of 70% for the predetermined period as indicated in Table 1. The surface protuberance number of each package of the feed yarn was determined. The results are indicated in Table 1. The feed yarn was, thereafter, draw-false twisted under the following conditions.

| | |
|---|---|
| Rotating speed of spindle | : $60 \times 10^4$ revolutions/min |
| Twist number on yarn | : 2600 turns/m |
| Heater temperature | : 190° C |
| Speed of delivery roller for drawing | : 230 m/min |
| Mechanical draw ratio | : 2.45 |

The properties of the resultant textured yarns are also indicated in Table 1.

In Comparative Example 1, procedures identical to those in Example 1 were repeated using a finishing agent of the composition B indicated below.

| Composition B | |
|---|---|
| Component | Part |
| Polyethylene glycol dilaurate | 15 |
| Copolymer of propylene oxide and ethylene oxide having a molecular weight of 500 | 35 |
| Stearyl ether of polyethylene glycol having a degree of polymerization of 7 | 7 |
| Stearyl ether of polyethylene glycol having a degree of polymerization of 5 | 8 |
| Castor oil ether of polyethylene glycol having a degree of polymerization of 10 | 7 |
| Dioctyl sebacate | 20 |
| Sodium salt of lauryl sulfonate of polyethylene glycol having a degree of polymerization of 5 | 5 |
| Potassium salt of lauryl phosphate of polyethylene glycol having a degree of polymerization of 5 | 3 |

The results are indicated in Table 1.

Table 1

| Exp. No. | Type of finishing agent | Aging (days) | Surface protuberance number of feed yarn | textured yarn: Tenacity (g/denier) | Breaking elongation (%) | Degree of total crimp (TC) (%) | Dye-absorbing property |
|---|---|---|---|---|---|---|---|
| | A | 0 | 0 | 3.8 | 32 | 32 | Standard |
| Example | A | 20 | 2 | 3.7 | 33 | 31 | + 0.2 |
| 1 | A | 40 | 4 | 3.7 | 32 | 32 | + 0.4 |
| Comparative | B | 0 | 1 | 3.7 | 31 | 31 | Standard |
| Example 1 | B | 40 | 20 or more | 3.4 | 32 | 25 | + 8.0 |

From Table 1, it is obvious that even if the feed yarn of Example 1 is aged over 40 days, the resultant textured yarn is substantially identical in crimp property, dye-absorbing property and mechanical properties to that produced without aging. However, in Comparative Example 1, the textured yarn produced from the feed yarn which has been aged for 40 days is obviously different in crimp property and dye-absorbing property from that produced without aging of the feed yarn.

EXAMPLES 2 THROUGH 4 AND COMPARATIVE EXAMPLES 2 THROUGH 6

In each of the Examples 2 through 4, procedures identical to those in Example 1 were repeated using the finishing agent of Composition A, except that the feed yarn was produced at the windup speed as indicated in Table 2, aged for the predetermined period as indicated in Table 2 and, thereafter, draw-false twisted at a heater temperature of 200° C at the predetermined draw ratio as indicated in Table 2. In the draw-false twisting operation, the yarn was maintained under a tension of 35 g by changing the speed of the delivery roller. The denier of the feed yarn adjusted so that the denier of the textured yarn resulting from the feed yarn was 150 deniers/30 filaments after the draw-false twisting operation.

In each of the Comparative Examples 2 through 4, operations identical to those of the example corresponding in number to the comparative example were repeated using the finishing agent of Composition B.

The results of the examples and the comparative examples are shown in Table 2.

In comparative Example 5, the same operations as in Example 2 were carried out, except that the feed yarn was produced at a windup speed of 3500 m/min. In Comparative Example 6, the same operations as in Comparative Example 2 were effected, except that the feed yarn was produced at a windup speed of 3500 m/min. The filaments in the feed yarns of Comparative Examples 5 and 6 had a birefringence of 0.049, which is outside of the scope of the present invention.

Table 2

| | | Feed yarn | | | | | Textured yarn | |
|---|---|---|---|---|---|---|---|---|
| Exp. No. | Windup speed (m/min) | Birefringence | Type of finishing agent composition | Aging (days) | Surface protuberance number | Mechanical draw ratio | Degree of total crimp (TC) (%) | dye-absorbing property |
| Exp. 2 | 1100 | 0.008 | A | 0 | 1 | 3.15 | 33 | Standard |
| | | | | 30 | 3 | | 33 | + 0.5 |
| Comp. Exp. 2 | | | B | 0 | 1 | | 32 | Standard |
| | | | | 30 | 20 or more | | 26 | + 10 |
| Exp. 3 | 2000 | 0.017 | A | 0 | 0 | 2.20 | 34 | Standard |
| | | | | 30 | 2 | | 31 | + 3 |
| Comp. Exp. 3 | | | B | 0 | 1 | | 34 | Standard |
| | | | | 30 | 10 or more | | 31 | + 5 |
| Exp. 4 | 2500 | 0.026 | A | 0 | 0 | 1.95 | 33 | Standard |
| | | | | 30 | 2 | | 34 | + 0.2 |
| Comp. Exp. 4 | | | B | 0 | 0 | | 33 | Standard |
| | | | | 30 | 10 or more | | 31 | + 3 |
| Comp. Exp. 5 | 3500 | 0.047 | A | 0 | 0 | 1.55 | 35 | Standard |
| | | | | 30 | 1 | | 35 | + 0 |
| Comp. Exp. 6 | | | B | 0 | 0 | | 35 | Standard |
| | | | | 30 | 4 | | 34 | 1 |

From Table 2, it is obvious that the effect in stabilization of the feed yarn of the process of the present invention increases with a decrease in the birefringence value of the filaments in the feed yarn. In the case where the birefringence of the feed yarn filaments are larger than 0.04, the effect, especially the stabilizing effect for the feed yarn, of the process of the present invention is indistinct, because this type of feed yarn naturally has a very small change in quality with the lapse of time.

Further, it is obvious that the feed yarn having a surface protuberance number of 5 or less has a very small change in the dye-absorbing property. Accordingly, for this type of feed yarn it is unnecessary to classify the packages of the feed yarn in accordance with the length of aging period.

EXAMPLE 5

In Example 5 procedures identical to those in Example 1 were carried out, except that the polyethylene terephthalate was melted at a temperature of 283° C, the windup speed was 2000 m/min, and the finishing agent of Composition A was applied in an amount of 0.15%, based on the weight of the feed yarn, to the feed yarn by the finishing agent applying roller located between the spinneret and the winding device. The feed yarn was of 325 deniers/30 filaments and was divided into 5 packages. Each package of the feed yarn was aged at a temperature of 40° C at a relative humidity of 70% for the predetermined period as indicated in Table 3. The filaments in the feed yarn had a birefringence of 0.017. The packages of the feed yarn were subjected to the draw-false twisting process. In the process, the finishing agent of Compostion A was further applied in an amount of 0.40%, based on the weight of the feed yarn to the feed yarn by a finishing agent applying roller located between a feed yarn supply creel and a feed roller of the draw-false twisting machine. The draw-false twisting operation was effected under the following conditions.

| | |
|---|---|
| Mechanical draw ratio for yarn | : 2.16 |
| Heater temperature | : 190° C |
| Twist number on yarn | : 2600 turns/min |
| Rotating speed of spindle | : $54 \times 10^4$ r.p.m. |
| Speed of delivery roller | : 208 m/min |

The properties of the resultant textured yarns are indicated in Table 3.

Table 3

| | Surface | Textured yarn | | | |
|---|---|---|---|---|---|
| Aging (days) | Protuberance number | Tenacity (g/d) | Breaking elongation (%) | Degree of total crimp (TC) (%) | Dye-absorbing property |
| 0 | 0 | 3.8 | 33 | 34 | Standard |
| 10 | 0 | 3.7 | 33 | 32 | 0 |
| 20 | 1.6 | 3.9 | 34 | 33 | + 0.2 |
| 40 | 2.0 | 3.6 | 33 | 34 | + 0.2 |
| 60 | 2.5 | 3.7 | 35 | 33 | + 0.4 |

What is claimed is:

1. A process for producing textured polyester multifilament yarn comprising the steps of:

providing a feed yarn consisting of a plurality of synthetic linear ethylene terephthalate polymer filaments having a birefringence value of at most 0.04, by melt-spinning said linear polyester to form an undrawn multifilament yarn, winding up said undrawn multifilament yarn at a speed of 2750 m/min or lower and, applying to said undrawn multifilament yarn, a finishing agent not capable of diffusing into the inside of said filaments but capable of preventing formation of protuberances at a surface protuberance number larger than 5, on the surface of said filaments when the resultant feed yarn is twisted at a twist number of 32500/D turns/m, wherein D represents a denier of said feed yarn, without drawing the yarn after aging the feed yarn at a temperature of 40° C at a relative humidity of 70% for 21 days, and;

subjecting said feed yarn to a simultaneous or sequential draw-twisting operation.

2. A process as claimed in claim 1, wherein said ethylene terephthalate polymer is polyethylene terephthalate.

3. The process as claimed in claim 1, wherein said ethylene terephthalate polymer is a copolymer containing at least 80% by mole of copolymerized ethylene terephthalate.

4. A process as claimed in claim 1, wherein said feed yarn is produced at a windup speed of 1500–2500 m/min.

5. A process as claimed in claim 1, wherein said finishing agent consists essentially of an ester oil lubricant, mineral oil lubricant, silicone oil lubricant, polyether lubricant consisting of copolymers of propylene oxide and ethylene oxide having a molecular weight of at least 2000, a non-ionic surface active compound having branch groups having 0 to 50 carbon atoms, or a mixture thereby.

6. A process as claimed in claim 5, wherein said mixture contains at least one member selected from the group consisting of said ester oil, mineral oil, silicone oil and polyether lubricants and at least one member selected from said non-ionic polymeric surface active compounds.

7. A process as claimed in claim 1, wherein said finishing agent is applied to said feed yarn in an amount of 0.2 to 1.0% based on the weight of said undrawn multifilament yarn.

8. A process as claimed in claim 1, wherein said draw-texturing operation is carried out at a mechanical draw ratio of 1.5X to 3.5X at a heat-setting temperature of 160° to 230° C.

* * * * *

UNITED STATES PATENT OFFICE
CERTIFICATE OF CORRECTION

Patent No. 4,044,541 Dated August 30, 1977

Inventor(s) Morio Ikeda

It is certified that error appears in the above-identified patent and that said Letters Patent are hereby corrected as shown below:

Column 1, line 40: "yard" should be --yards--.

line 54: "microstructue" should be --microstructure--

Column 3, line 4: "borin" should be --boric--.

line 17: "melt spinning" should be --melt-spinning--.

line 34: "quadangle" should be --quadrangle--.

Column 4, line 14: delete "shown in Fig.2 is".

Column 6, line 7: "silicon" should be --silicone--.

Column 9, line 54: "three package" should be --three packages--

Column 13, line 8: "the" should be --A--.

Column 14, line 3: "thereby" should be --thereof--.

Signed and Sealed this

*Eighteenth* Day of *April 1978*

[SEAL]

*Attest:*

RUTH C. MASON
*Attesting Officer*

LUTRELLE F. PARKER
*Acting Commissioner of Patents and Trademarks*